US011795792B2

(12) United States Patent
Archibald et al.

(10) Patent No.: US 11,795,792 B2
(45) Date of Patent: Oct. 24, 2023

(54) MICRO-CONTROLLER-BASED SWITCH ASSEMBLY FOR WELLBORE SYSTEMS AND METHOD

(71) Applicant: GEODYNAMICS, INC., Millsap, TX (US)

(72) Inventors: Roger Archibald, Hurst, TX (US); Jason Ansley, Bedford, TX (US); Brad Perry, Santo, TX (US)

(73) Assignee: GEODYNAMICS, INC., Millsap, TX (US)

( * ) Notice: Subject to any disclaimer, the term of this patent is extended or adjusted under 35 U.S.C. 154(b) by 0 days.

(21) Appl. No.: 17/835,353

(22) Filed: Jun. 8, 2022

(65) Prior Publication Data

US 2022/0298896 A1 Sep. 22, 2022

Related U.S. Application Data

(63) Continuation of application No. 17/144,328, filed on Jan. 8, 2021, now Pat. No. 11,384,626, which is a continuation of application No. 16/014,125, filed on Jun. 21, 2018, now Pat. No. 10,914,146.

(51) Int. Cl.

| | |
|---|---|
| ***E21B 43/1185*** | (2006.01) |
| ***H01H 47/02*** | (2006.01) |
| ***E21B 47/12*** | (2012.01) |
| ***F42D 1/05*** | (2006.01) |

(52) U.S. Cl.
CPC .... *E21B 43/1185* (2013.01); *E21B 43/11857* (2013.01); *E21B 47/12* (2013.01); *F42D 1/05* (2013.01); *H01H 47/02* (2013.01)

(58) Field of Classification Search
CPC ..... E21B 43/1185; E21B 43/11857; E21B 47/12; F42D 1/05; H01H 47/02
See application file for complete search history.

(56) References Cited

U.S. PATENT DOCUMENTS

2005/0150687 A1* 7/2005 Vicente ..... F42D 1/055 175/4.51
2013/0300569 A1 11/2013 Lerche
2016/0333676 A1* 11/2016 Hardesty ..... F42D 1/05

OTHER PUBLICATIONS

European Patent Office; Supplementary European Search Report, EP 19 823 398.3; dated Jan. 26, 2022.

* cited by examiner

*Primary Examiner* — Dany E Akakpo
(74) *Attorney, Agent, or Firm* — Morgan, Lewis & Bockius LLP

(57) ABSTRACT

A switch assembly, which is part of a chain of switch assemblies. The switch assembly includes a micro-controller PB that has no address, a thru-line switch, and a detonator switch. The micro-controller PB is configured to directly communicate with an upstream or downstream switch assembly through a pulsing scheme, and the micro-controller PB receives no command from a surface controller.

13 Claims, 8 Drawing Sheets

MICRO-CONTROLLER-BASED SWITCH ASSEMBLY FOR WELLBORE SYSTEMS AND METHOD

BACKGROUND

Technical Field

Embodiments of the subject matter disclosed herein generally relate to downhole tools for perforating and fracking operations, and more specifically, to a gun string having one or more micro-controller-based switch assembly for activating a corresponding detonator from a plurality of detonators.

Discussion of the Background

After a well 100 is drilled to a desired depth H relative to the surface 110, as illustrated in FIG. 1, and the casing 110 protecting the wellbore 104 has been installed and cemented in place, it is time to connect the wellbore 104 to the subterranean formation 106 to extract the oil and/or gas.

The process of connecting the wellbore to the subterranean formation may include the following steps: (1) placing a plug 112 with a through port 114 (known as a frac plug) above a just stimulated stage 116, (2) closing the plug, and (2) perforating a new stage 118 above the plug 112. The step of perforating is achieved with a gun string 120 that is lowered into the well with a wireline 122. A controller 124 located at the surface controls the wireline 122 and also sends various commands and/or voltages along the wireline to actuate one or more gun assemblies of the gun string.

A traditional gun string 120 includes plural carriers 126 connected to each other by corresponding subs 128, as illustrated in FIG. 1. Each sub 128 includes a detonator 130 (in a traditional configuration) and a corresponding switch 132. The detonator 130 is not connected to the through line (a wire that extends from the surface to the last gun and transmits the actuation voltage to the charges of the gun) until the corresponding switch 132 is actuated. The corresponding switch 132 is actuated by the detonation of a downstream gun. When this happens, the detonator 130 becomes connected to the through line, and when a command or voltage change from the surface actuates the detonator 130, the upstream gun is actuated.

For a conventional perforating gun string 120, carriers 126 are first loaded with charges and a detonator cord. Gun strings are then built up, one gun assembly at a time, by connecting the loaded carriers 126 to corresponding subs 128. These subs may contain the switch 132 with pressure bulkhead capabilities. Once the sub is assembled to the gun string, the wires and detonation cord are pulled through a port in the sub, allowing for the installation of the detonator, the corresponding switch, and the connection of the wirings. Those skilled in the field know that this assembly operation has its own risks, i.e., miswiring, which may render one or more of the switches and corresponding detonators unusable.

After a conventional gun string has been assembled, none of the detonators are electrically connected to the through wire or through line running through the gun string. This is because between each gun assembly there is a pressure-actuated single pole double throw (SPDT) switch. The normally closed contact on these switches connects the through wire from one gun assembly to another gun assembly. Once the switch has been activated by the blast of the gun assembly beneath (when that gun goes off), the switch changes its state, connecting the through wire coming from above to one lead of the detonator. The other lead of the detonator is wired to the ground the entire time.

In this configuration, after assembly, it is not possible to select which switch of the plurality of switches is to be activated. Once a fire command or voltage is sent from the controller 124, the most distal switch is activated. The blast from the corresponding gun assembly then activates the next switch and so on.

U.S. Pat. No. 6,604,584 discloses a downhole activation system that uses control units having "pre-assigned identifiers to uniquely identify each of the control units," and based on these identifiers, a central controller can communicate with a selected control unit. This downhole activation system requires the central controller to interrogate, when the system is started, each control unit to determine its address. If an address has not been assigned to a control unit, the downhole activation system would assign an address to that control unit. However, this process is cumbersome and slow.

International patent application PCT/US2018/022846 discloses an addressable switch that overcomes the above mentioned deficiencies of U.S. Pat. No. 6,604,584. However, all the addressable switches suffer from the fact that the speed of communicating with the various switches in a chain of switches is low (e.g., about 1 second per switch) and the surface equipment necessary for controlling and communicating with the downhole switches is expensive and complex, which requires not only a high investment, but also a highly skilled technician for manning the switches.

Thus, there is a need to provide a downhole system that overcomes the above noted problems and offers the operator of the system the possibility to quickly and cheaply activate a switch to fire a gun assembly.

SUMMARY

According to an embodiment, there is a method for firing a detonator in a chain of switch assemblies. The method includes a step of lowering the chain of switch assemblies into a wellbore, a step of powering-up a switch assembly of the chain of switch assemblies, a step of independently entering through a set of states during which the switch assembly interacts with a downstream switch assembly and determines a status of one or more elements associated with the switch assembly, and a step of firing a detonator electrically connected to the switch assembly or entering a sleeping state.

According to another embodiment, there is a switch assembly, which is part of a chain of switch assemblies. The switch assembly includes a power supply, a micro-controller PB that has no address; a thru-line switch including a first semiconductor element, and a detonator switch including a second semiconductor element, where the micro-controller PB is configured to directly communicate with an upstream or downstream switch assembly through a pulsing scheme.

According to yet another embodiment, there is a system for firing a gun string. The system includes a chain of switch assemblies to be distributed in a well, and a surface controller connected to the chain of switch assemblies and located at a head of the well. The surface controller does not send any command to fire a detonator, and each switch assembly of the chain of switch assemblies includes a micro-controller that has no address.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to three hybrid switch assemblies connected in series to each other. However, the embodiments discussed herein are applicable to any number of switches.

Reference throughout the specification to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Figure 2:
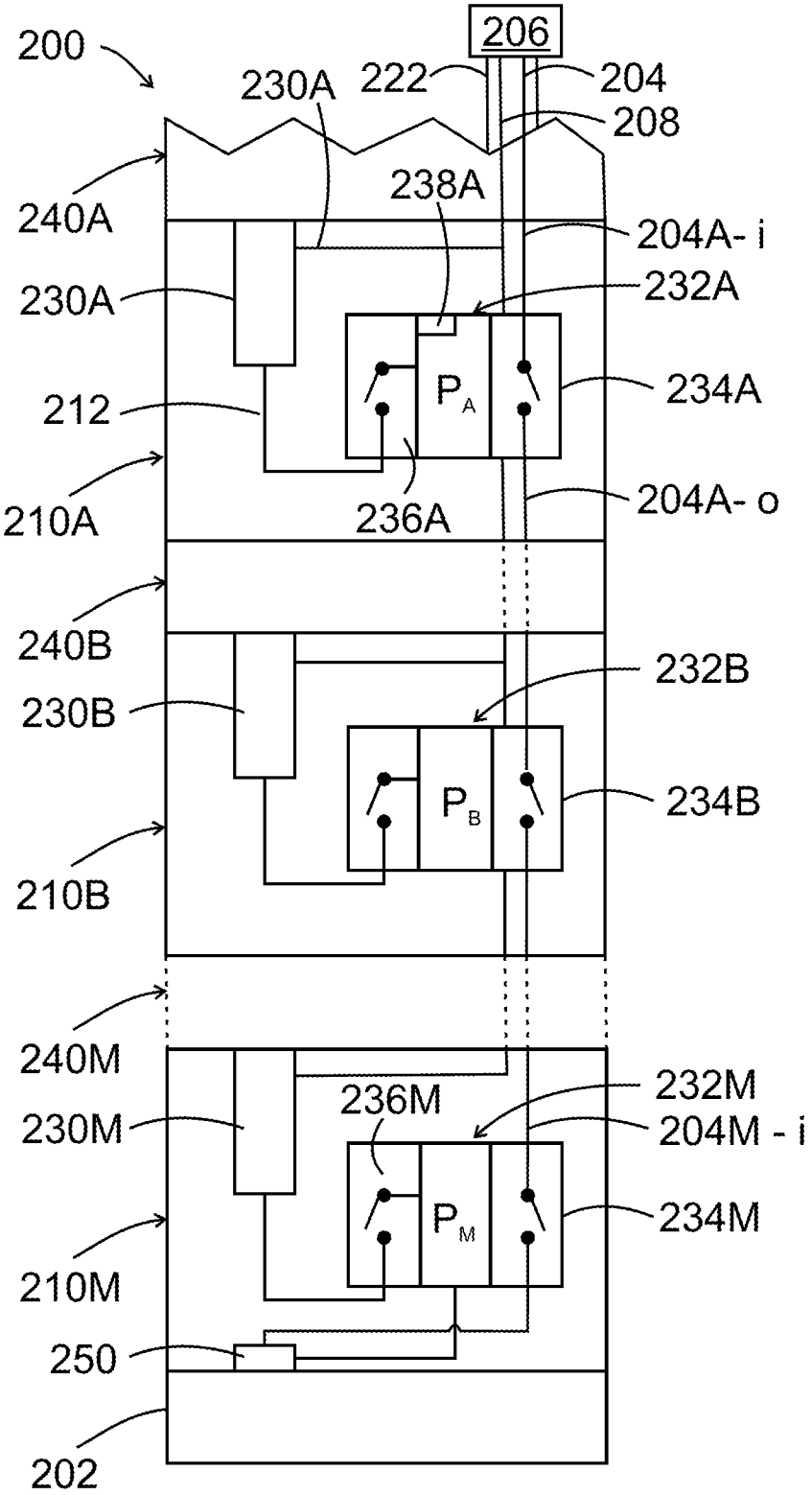
FIG. 2 illustrates a chain of hybrid switch assemblies and associated gun assemblies.

According to an embodiment illustrated in FIG. 2, a gun string 200 includes plural gun assemblies 240 (shown as elements 240A to 240M, where M can take any integer value larger than 2) connected to each other through corresponding subs 210 (numbered 210A to 210M in the figure). Note that each gun assembly (except for the upper gun assembly 240A and the lower gun assembly 240M) is sandwiched by two subs. One skilled in the art would understand that the embodiments discussed herein are also applicable if the gun assemblies are attached to each other without the subs 210. In other words, while FIG. 2 shows each sub housing a corresponding switch and detonator, it is also possible to place one or both of the switch and the detonator outside the sub, especially if the gun string 200 has no sub. This means that the location of the switch and detonator for the purpose of this invention is not to be construed as limiting the embodiments, as these elements can be located anywhere along the gun string. For simplicity, FIG. 2 shows the switch and detonator being located in a sub, where these elements are traditionally located, but this feature does not limit the following embodiments or the claims.

The upper gun assembly 240A is considered to be the gun assembly first connected to the wireline 222 and the lower gun assembly is considered to be the gun most distal from the wireline, i.e., the gun assembly that is connected to the tool setting 202.

Plural hybrid switch assemblies 232A to 232M and plural detonators 230A to 230M are distributed along the gun string 200. In this embodiment, each sub 210 includes a corresponding switch assembly and a detonator, i.e., sub 210A includes switch assembly 232A and detonator 230A. The same is true for all other subs. Note that it is possible to have a gun string that has no sub, as noted above. In this case, the switch assembly and the detonator are located in corresponding gun assemblies 240A. Detonator 230A is electrically connected to hybrid switch assembly 232A and ballistically connected to the corresponding gun assembly 240A. The same is true for the other gun assemblies, detonators and switch assemblies.

The hybrid switch assembly 232A (in the following, reference is made to a particular switch assembly, but it should be understood that this description is valid for any switch assembly in the chain of switch assemblies shown in FIG. 2) includes a micro-processor PA (e.g., application-specific integrated circuit or field-programmable gate array or equivalent semiconductor device) that is electrically connected to two switches. A first switch is the thru-line switch 234A, which may be implemented in software, e.g., firmware, or hardware or a combination of both. The thru-line switch 234A is connected to a thru-line 204 (center conductor of the wireline 222). The thru-line switch 234A is controlled in this embodiment by the microprocessor PA. The thru-line 204 may extend from a surface controller 206 along the wireline 222. The portion of the thru-line 204 that enters the hybrid switch assembly 232A is called herein the input thru-line 204A-i and the portion that leaves the hybrid switch assembly 232A is called the output thru-line 204A-o. When the thru-line switch 234A is open, power or voltages sent from the controller 206 cannot pass through the hybrid switch assembly 232A, to the next hybrid switch assembly 232B. By default, all the thru-line switches 234A to 234M are open.

In this embodiment, controller 206 is configured to send only various voltages to the thru-line 204, but no commands. A command is defined herein as a signal including a data packet. When the controller 206 sends a voltage change, i.e., a voltage increase or decrease, there is no data packet involved. Thus, by simply changing a voltage value in the line 204, a hybrid switch assembly can be activated. However, changing a voltage in a line is not equivalent to sending a command (i.e., information embedded into a data packet). This means that for this embodiment, in which the controller 206 does not send commands to the switch assemblies, an addressable switch as discussed in the background section with regard to U.S. Pat. No. 6,604,584 or International Application PCT/US2018/022846 could not receive any data from the controller 206 along line 204, which would render this kind of addressable switch inoperative. In this regard, note that an addressable switch needs to exchange data packets with a surface controller in order to control the switch. The hybrid switch assembly that is discussed herein (called hybrid because it includes a controller as an addressable switch, but is controlled only by changing a level of the applied voltage, as in a traditional mechanical switch) does not use data packets for being actuated, just a change in the voltage level in the thru-line 204.

Because the surface controller 206 does not need to send data, it may be an inexpensive surface panel. In its most simplest implementation, the surface controller 206 includes only a power supply that is capable of applying different voltages between the two lines 204 and 208. However, the surface controller 206 may also include, in one application, a processor that counts how many hybrid switch assemblies are present and a display for showing the number of hybrid switch assemblies to the operator of the surface controller. Because the surface controller 206 is configured to not send any command to the hybrid switch assemblies, this means that if an addressable switch is connected to this controller, the operator could not send any fire command or other commands to the addressable switches. However, in one embodiment, it is possible to add more functionality to the surface controller to make it compatible with an addressable switch.

This embodiment shows two lines (the thru-line 204 and a wireline armor line 208) extending from the controller 206 to the lower thru-line switch assembly 234M. However, those skilled in the art would understand that more than two lines may extend to the various hybrid switch assemblies, e.g., various lines that extend only between adjacent switch assemblies. Further, a ground wire may extend in parallel to the thru-line. In this embodiment, the ground wire's role is performed by the casing of the gun assembly. Wireline armor 208 extends from the controller 206 to each of the hybrid switch assembly.

The hybrid switch assembly 232A (herein called simply a switch assembly) also includes a detonator switch 236A, which is also controlled by microprocessor PA. The detonator switch 236A may be implemented similar to the thru-line switch 234A. The detonator switch 236A is by default open, and thus, no voltage is transmitted from the controller 206 or the micro-processor PA to the corresponding detonator 230A along line 212. The switch assembly 232A may also include a memory 238A (e.g., EPROM memory) for storing one or more instructions and/or pulse schemes, as discussed later. In one application, neither the microprocessor PA nor the memory 238A stores any ID or address.

Figure 1:
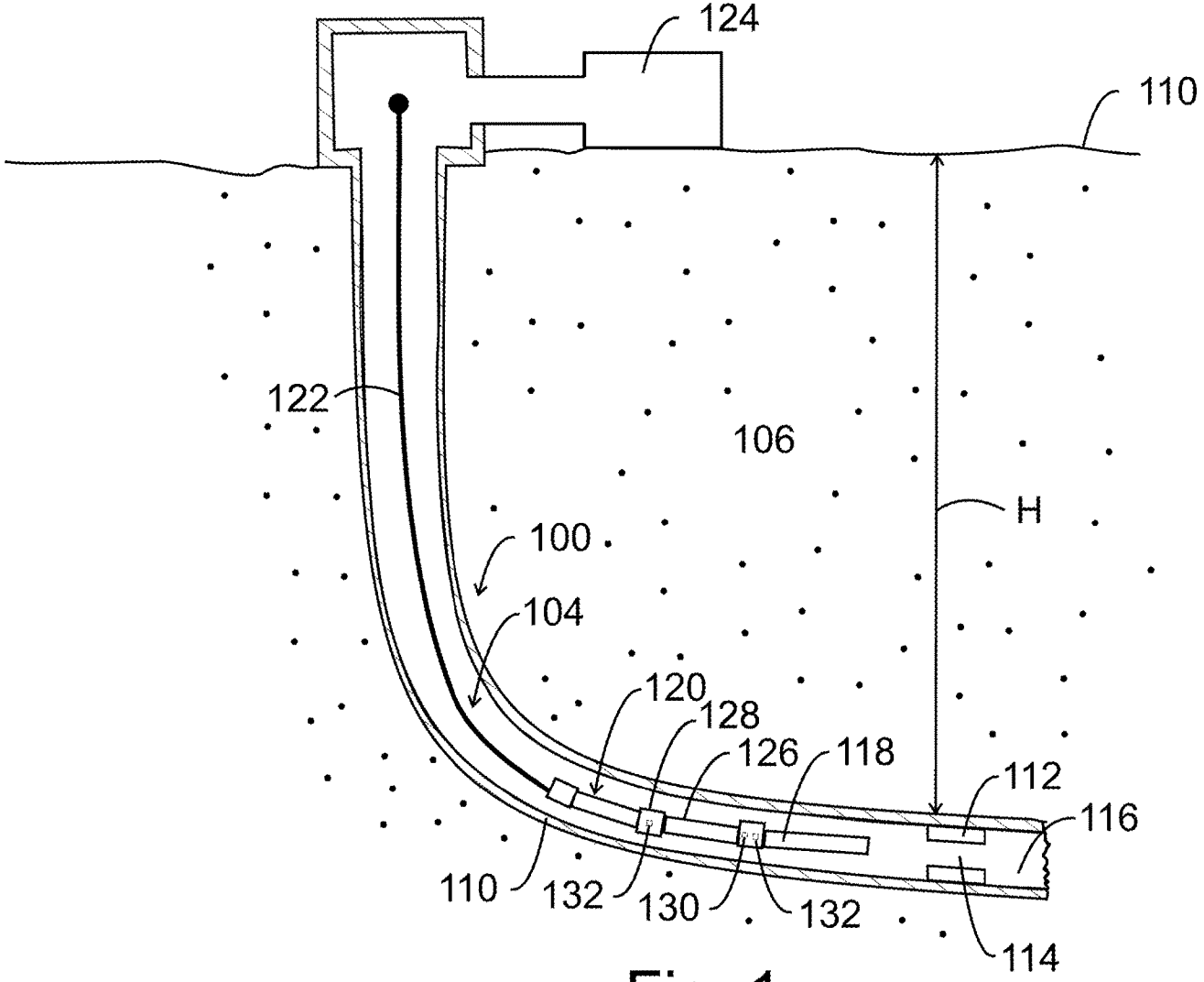
Fig. 1 (Background Art)
FIG. 1 illustrates a well and associated equipment for well completion operations.

The lower switch assembly 234M may be different from the other switch assemblies in the sense that the switch assembly 234M may also be connected, in addition to the input thru-line 204M-i and to the detonator 230M, to a setting tool detonator 250. The setting tool detonator 250 may have the same configuration as the detonator 230M, but it is used to actuate the setting tool 202. The setting tool 202 is used to set the plug 112 (see FIG. 1). Thus, the lower switch assembly may need to distinguish between two modes: (1) firing the gun detonator 230M or (2) firing the setting tool 202. In one application, the closing of the thru-line switch 234M activates the setting tool and the closing of the detonator switch 236M activates the detonator 230M. As will be discussed later, it is possible for the lowest switch assembly (also called the setting switch assembly) to be configured to send a pair of pulses separated by a given time interval, to signal the presence of a plug instead of a detonator. The given time interval may be (e.g., 15 ms) different from the time interval (e.g., 20 ms) used for indicating the presence of an inline switch or the time interval (e.g., 10 ms) used for indicating the presence of a bottom switch assembly. In another implementation, the lowest switch assembly 232M is not connected to the setting tool 202.

Figure 3:
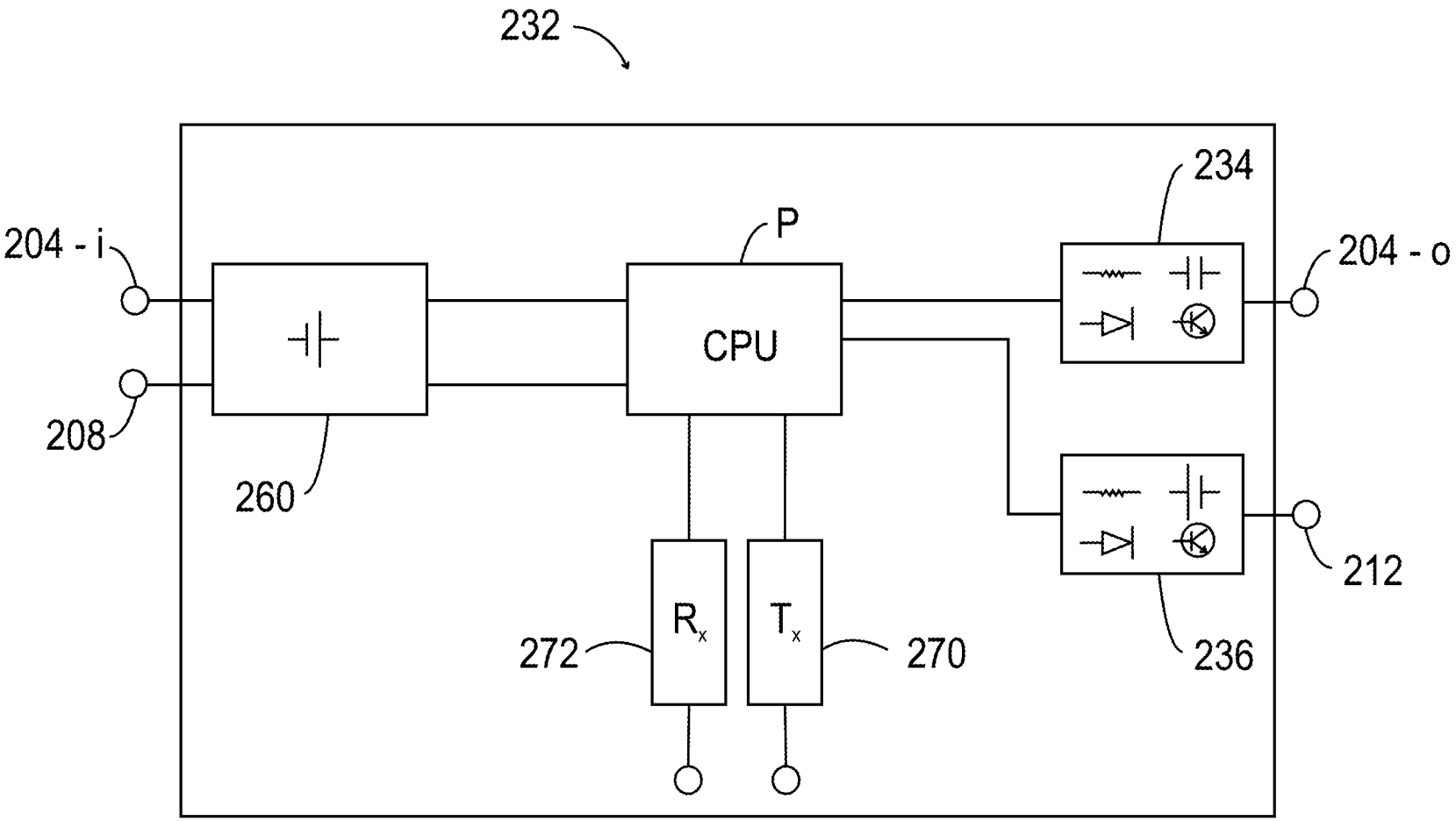
FIG. 3 illustrates a hybrid switch assembly.

A configuration of a switch assembly 232 (which can be any of the switch assemblies 232A to 232M discussed with regard to FIG. 2) is illustrated in more detail in FIG. 3. Switch assembly 232 includes the thru-line switch 234 and the detonator switch 236. As discussed above, these two switches may be implemented in hardware (e.g., with semiconductor devices that may include one or more diodes and/or transistors) or in software or both. In this embodiment, it is assumed that the two switches are implemented in hardware, i.e., each switch includes at least one transistor and plural diodes, resistors, and capacitors, as symbolically illustrated in the figure.

Further, switch assembly 232 includes the micro-processor P and a power unit 260, which is configured to provide various voltages to the switch assembly. For example, power unit 260 may include one or more transistors, diodes, resistors and capacitors. In one application, power unit 260 is connected to wires 204 and 208, from the wireline 222, and communicate with controller 206. The power unit 260 may also generate various DC voltages, e.g., 12 V and 5 V for internal nodes of the switch assembly 232.

Processor P is also connected to a transmit module 270 and receive module 272, both of which are part of the switch assembly 232. Each of these two modules is implemented in hardware and may include, for example a transistor and a resistor. It is noted that a generic transmit module or receive module or switch assembly or processor is indicated in FIG. 3 by a corresponding reference number (e.g., 232) while the same element, when present in a chain of switch assemblies, is indicated by the corresponding reference number followed by a letter (e.g., 232A) that is specific to each switch assembly in the chain.

Figure 4:
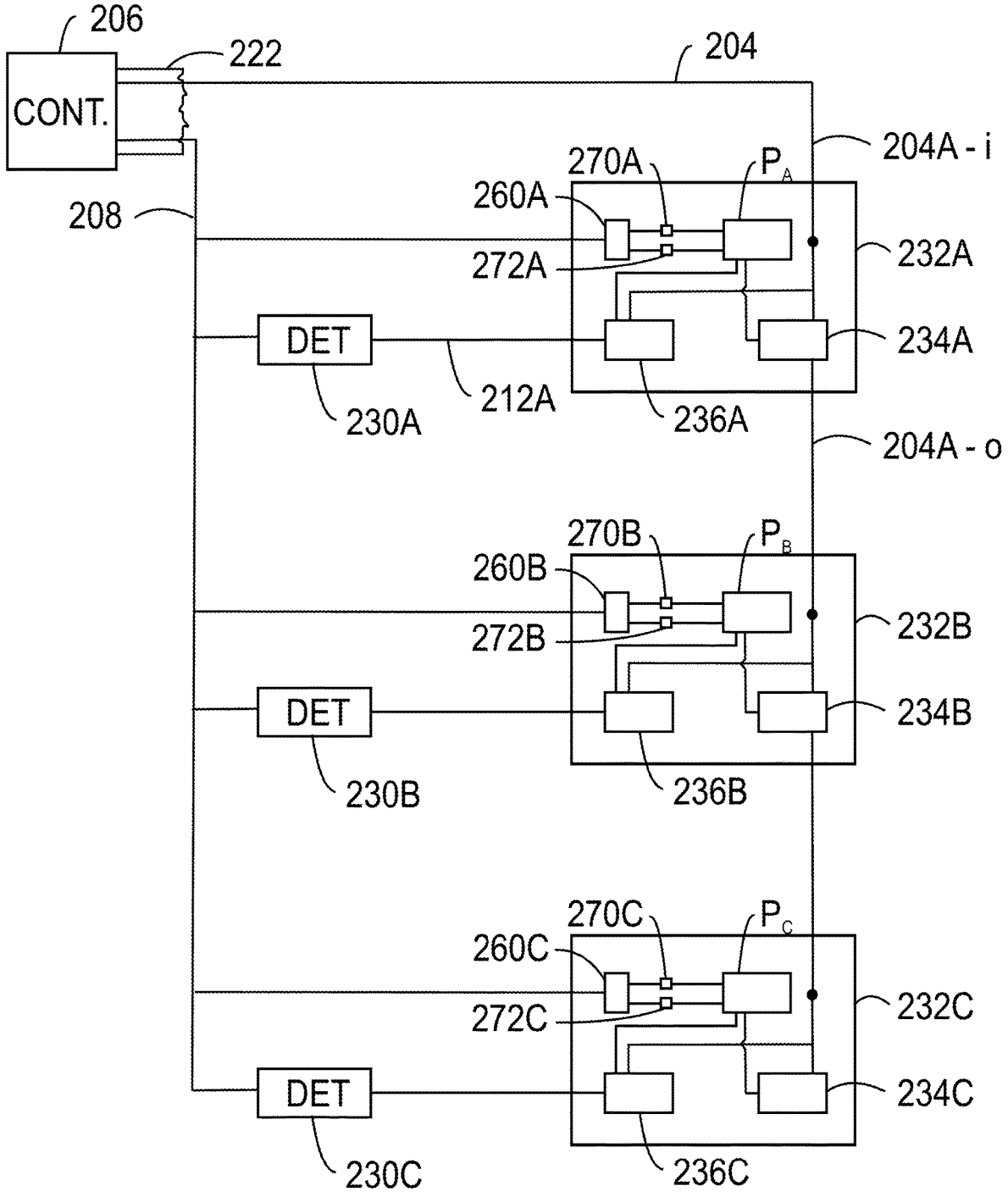
FIG. 4 illustrates a chain of hybrid switch assemblies and the electrical connections among these elements.

The functionalities of the switch assembly shown above is now discussed with regard to FIGS. 4 and 5. For simplicity, FIG. 4 shows a chain of switch assemblies that has only three switches. Also for simplicity, each switch assembly is shown as a box having two switches, one micro-processor, one transmit module and one receive module. The switch assembly 232A is considered to be closest to the top of the well and the switch assembly 232C is considered to be closest to the toe of the well. The charges and other physical elements that are attached to the guns or make up the guns are omitted for simplicity. The figure shows only the three switch assemblies and their electrical connections to other switches, to a controller from the surface, and to their detonators.

Figure 5:
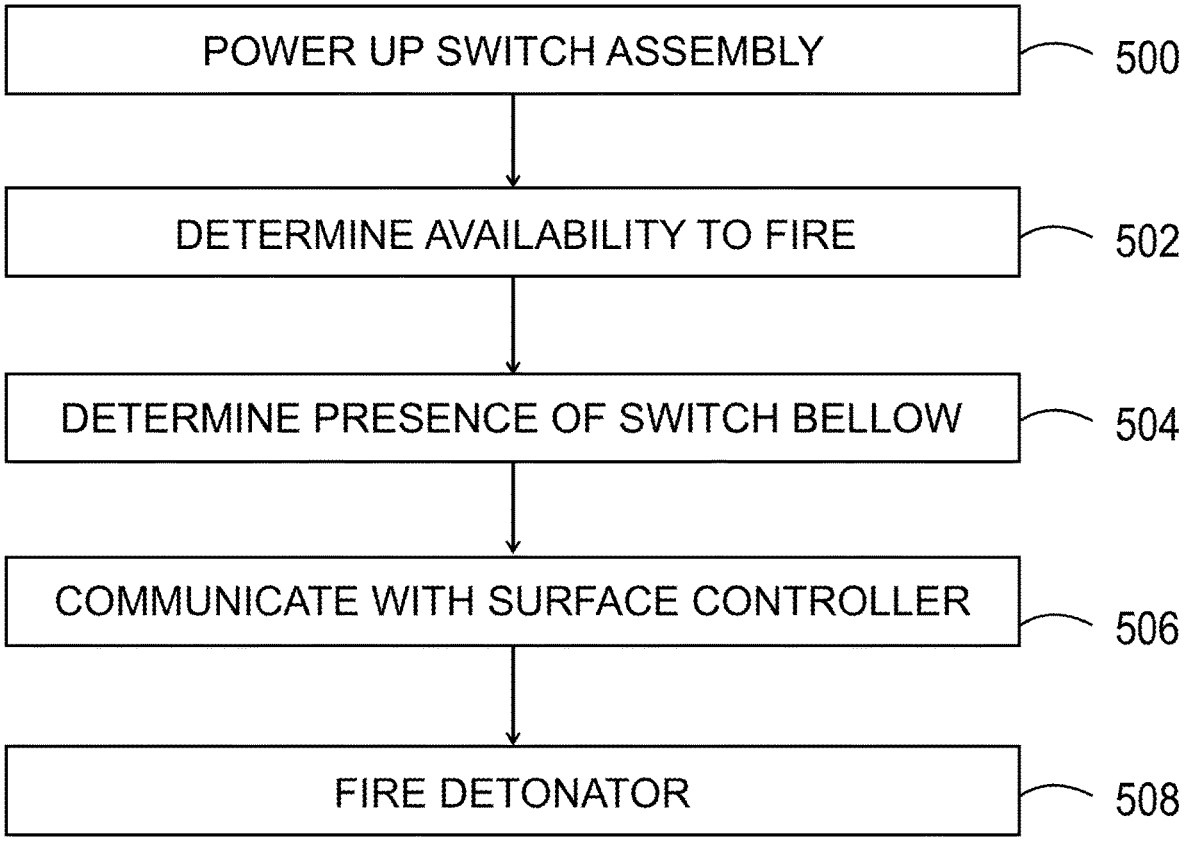
FIG. 5 is a flowchart of a method for firing a detonator with a hybrid switch assembly.

FIG. 5 is a flowchart of a method for firing a switch assembly that is part of a chain of switch assemblies as shown in FIG. 4. Note that each switch assembly is a hybrid switch assembly, i.e., does not have an address and no commands are used from the surface to fire the hybrid switch assembly. Each of the switch assemblies is programmed to go through various state machines. In one implementation, each switch assembly goes through 6 state machines, as now discussed. Those skilled in the art would understand that the switch assemblies may be go through more or less state machines.

First, the string of switch assemblies is powered up in step 500 with a selected voltage. In this embodiment, the selected voltage (called herein powering voltage) is a negative voltage between 20V and 90V, which is applied between wires 204 and 208 in FIG. 4. Other voltages may be used. Once the chain of switch assemblies is powered up, the switch assemblies are initiated, one by one down the gun string, with each switch assembly making in step 502 a determination on whether or not it is able to fire. Then, in step 504, the switch assembly communicates locally, with an adjacent switch assembly (usually located further downhole) to determine whether or not there is a switch below it, which is also able to fire. As each switch assembly makes these determinations, it will send in step 506 a pair of voltage pulses to the surface controller 206. A simple surface controller 206, as already discussed, can interpret these pulses to determine how many switch assemblies are online, knowing that the bottom switch assembly 232C will fire when the line voltage is increased above a firing voltage. In this implementation, the firing voltage is larger than 140V. Then, the surface controller increases the line voltage to be larger than the firing voltage, and the bottom switch assembly, upon detection of this increase in voltage, and within a certain time window, fires in step 508 the detonator associated with it.

After a switch assembly is fired in step 508, the power to the chain of switch assemblies is interrupted and then reapplied to the entire chain, so that the configuration process described in steps 500 to 506 is repeated after each firing, to determine again which is the current bottom switch assembly. If a wiring issue or electronics failure downhole prevents a switch assembly from being able to fire, the switch assembly above it will automatically become the last switch assembly in the string. Note that this process is independent of any instructions from the surface controller, i.e., requires no commands from the surface controller.

The six state through which each switch assembly goes are now discussed. A first state into which a switch assembly enters is the POWER-UP state. An inventory process associated with the powering-up state of the chain of switch assemblies happens at a rate of about 5 switches/second, with a slight delay on the first switch assembly while waiting for the wireline voltage to stabilize on power-up. The switch assembly's firmware implements this state machine as described below. On each power-up, an active switch assembly that has a detonator present will take approximately 200 ms to run through this state machine. The switch assembly will first check if it has been previously fired (i.e., is there an inert flag set). If this flag is set, the switch assembly will go to sleep. Otherwise, the switch assembly will start scanning the head voltage (i.e., the voltage between lines 204 and 208 in FIG. 4) by reading an analog-to-digital converter's input VIN, and not take any further action unless the following two conditions are met:

(1) The line voltage is stable (e.g., the line voltage has not changed by more than 5V) at a value less than 90V for the last T1 seconds (e.g., T1=16 ms); and (2) The switch assembly has been powered up for at least T2 seconds (e.g., T2=20 ms).

By requiring that these two conditions are met, the switch assembly cannot get into a firing state, as a result of the firing voltage being immediately applied, either intentionally or due to the line 'browning out' after firing a previous switch assembly. The head voltage reading that is described above will be referenced later to determine if the feedthrough line is shorted. Once the required conditions have been met, the switch assembly will check for the presence of a detonator. Note that all future timings of the switch assembly is based on the time at which the switch assembly exits this state (i.e., a pulse generated by the switch 200 ms after the power-up action is actually referenced as being 180 ms after leaving this state).

Each switch assembly in the string will end up in one of 3 possible states after power-up:

It will determine that it cannot fire, due to not having a detonator or having previously been set an 'inert,' and will go to sleep; or It will determine that it is able to fire and that there is another detonator-equipped switch assembly below it, in which case it will enable power to the lower switch assembly and then go to sleep; or It will determine that it is able to fire and that there are no detonator-equipped switch assemblies below it, in which case it will dump-fire on the detonator if a line voltage is sensed to be larger than the firing voltage (e.g., 140V) within a given time window (for example, a 45-second window).

A second state of the switch assembly is the DETONATOR CHECK state. Once the switch assembly's line voltage has stabilized, it will check whether or not it senses a detonator. The presence of a detonator essentially means that there is a 50-ohm resistor connected between the wireline armor line 208 (see FIG. 4) and the line 212A (see FIG. 4) connecting the detonator switch 236A to the detonator 230A. This determination is made by the processor PA by sensing an appropriate voltage for the detonator. If the voltage sensed on the detonator line is larger than 20V, the processor PA of the switch assembly 232A determines that a detonator 230A is present. If no detonator is detected, the micro-controller instructs the switch assembly to go to sleep and would not attempt to communicate with the surface controller or any other switch assemblies. If a detonator is detected by the micro-controller, the micro-controller of the switch assembly will place a short (24 μs) pulse on the line (204A-i) to alert the next switch assembly (above) that there is a switch assembly below with a detonator. The switch assembly will then do nothing for 75 ms, following which it will check its feedthrough connection 204A-o.

A third state of the switch assembly is the FEEDTHROUGH or thru-line check state. The feedthrough check will make a determination of whether or not the feedthrough line 204A-o is shorted. If the feedthrough line is shorted, there will be a voltage that is close to VIN present on line 204A-o. A voltage on this line is measured and if it is within 5V of the voltage VIN, the micro-controller of the switch assembly determines that the feedthrough line is shorted. If the feedthrough line is shorted, the micro-controller of the switch assembly decides that it must be the final switch assembly in the string and so it goes to the PRE-FIRE state. If the feedthrough line is not shorted, the micro-controller of the switch assembly will enable its bypass line (i.e., close the thru-line switch 234A) and prepare to listen for a 24 μS pulse indicating that a switch assembly below has a detonator. The terms "below" and "above" are used herein to mean "downstream" and "upstream" relative to a well.

A fourth state of the switch assembly is the LISTEN state for a lower switch assembly. As noted above, a switch assembly will not do anything after power is applied, until it has been powered on for at least 20 ms and its head voltage is stable. The 'Listen' state is entered directly after the feedthrough line has been enabled, and the first thing that the micro-controller will do during the 'Listen' state is to wait for 15 ms and then enable an interrupt to be triggered if a pulse from a lower switch assembly is detected. The micro-controller will then wait another 15 ms, turn off the bypass (i.e., switch 234A) to a lower switch assembly, and then check whether or not an interrupt was generated inside the listening window. If an interrupt was not generated, the switch assembly determines that there are no detonator-equipped switch assemblies below it and so it will go to the PRE-FIRE state. If an interrupt was generated, this will be interpreted as a lower switch assembly having a detonator is present and the micro-controller will go to the INLINE state.

A fifth state of the switch assembly is the INLINE state. If a switch assembly is in this state, it has determined that it has a detonator and that there is a switch assembly below it that also has a detonator. The micro-controller will inform the surface controller that it is an inline switch assembly by sending two long pulses P1 and P2, at times T3 and T4 (e.g., T3=180 ms and T4=200 ms after power-up). Immediately after this, the micro-controller will enable the bypass line (thru-switch 234A) for the next switch assembly to start its inventory process, and then go to sleep to minimize current consumption.

A sixth state of the switch assembly is the PRE-FIRE state. If a switch assembly reaches this state, it has determined that it has a detonator, but there are no detonator-equipped switch assemblies below it. The micro-controller will inform the surface controller, through the transmit module 270, that it is a terminating switch assembly. The micro-controller will send two long pulses P3 and P4 at times T5 and T6 (for example, T5=190 ms and T6=200 ms), and then prepare to dump fire on the detonator when the line voltage is detected to be above the firing voltage (e.g., 140V). Immediately after sending these two pulses, the switch assembly will start a timer for measuring a time window (e.g., 45-second timer) and then again verify that its head voltage is below 90V and stable for at least 20 ms. Once this has been confirmed, it will start reading its head voltage to determine if a voltage larger than the firing voltage (e.g., 140V) is present. If the voltage larger than the firing voltage is detected, the micro-controller will mark itself as inert for any future power-ups, and then enable the fire line 212A. If the 45-second timer expires before the firing voltage is sensed, the switch assembly will go to sleep and a power cycle will be required to reconfigure the string of switch assemblies.

A further state, which is optional, is the SETTING TOOL CHECK state. Alternatively, one of the previous states may be modified to include the functionality discussed herein. Once the switch assembly's line voltage has stabilized, it will check whether or not it senses a setting tool. In one application, the switch assembly would also check for the presence of a detonator not related to the setting tool. This determination is made by the processor PA by sensing an appropriate voltage for the setting tool. If the processor PA of the switch assembly 232C determines that a setting tool 202 is present, the switch assembly sends two pulses to the surface controller to inform about this determination. Further, the switch assembly 232C will place a short (24 μs) pulse on the line (204C-i) to alert the next switch assembly (above) that there is a switch assembly below with a setting tool and/or a detonator. The two pulses may be separated by 15 ms as previously discussed. If no setting tool is detected and no detonator is detected, the micro-controller instructs the switch assembly to go to sleep and would not attempt to communicate with the surface controller or any other switch assemblies. If no setting tool is detected but only a detonator is detected, the micro-controller of the switch assembly will place a short (24 μs) pulse on the line (204A-i) to alert the next switch assembly (above) that there is a switch assembly below with a detonator. The switch assembly will then do nothing for 75 ms, following which it will check its feed-through connection 204A-o.

One skilled in the art would understand that the times and voltages used to describe the 6 (7) states above are exemplary and other values may be used. Also, one skilled in the art would understand the simplicity of the communication scheme used by the micro-controllers for communicating with the surface controller or with other micro-controllers from the chain. In this respect, the examples discussed above use simply pulses with different time separations for communication. Thus, no address of the micro-controller is necessary for performing this type of communication.

A specific implementation of the micro-controller P is now discussed. In this specific implementation, the micro-controller may be a PIC16F1615 controller. The micro-controller can be programmed to execute code to run the state machines discussed above and control the following input/outputs (I/O):

Pulse Transmission: Transmitting of pulses is handled by driving a FET transistor that is part of the transmit module 270. When this FET transistor is turned on, it pulls down on a 12V line via a resistor, resulting in a pulse being transmitted onto the line through 204A-i.

Pulse Reception: The base of an NPN transistor (which is part of the receive module 272) is normally biased on via a resistor, pulling the NPN transistor's collector low. When a pulse is placed on the line, it will be coupled across a capacitor onto the NPN transistor's base via another resistor. As the NPN transistor's base goes low, the collector will go high, placing a positive pulse on the micro-controller P for the duration of the pulse.

Analog sense lines: There are 3 analog inputs being used on the micro-controller P. These analog inputs VSEN, F_SNS and S_SNS can measure the voltage on the VIN line (i.e., 204A-i), the Fire line 212A, and the feedthrough line 204A-o, respectively. Each analog input is fed via a resistor divider that will divide the input signal by −151. The ADC has a resolution of 1024 and a reference voltage of 4.096V, giving a resolution of −4 mV/count. Considering the input resistor dividers, this translates to (4 mV*151=)−0.604V/count.

Switch/Charge pump circuits: The FIRE circuit 236 and the SET circuit 234 are virtually identical in this embodiment and can be used to provide a return to the detonator or feedthrough lines, respectively. To enable the feedthrough line, a pulsed output is produced on a pin of the micro-controller and fed onto the charge pump of the thru-line switch 234. The charge pump includes plural capacitors and diodes and produce a DC gate voltage on a transistor, which will enable the feedthrough line, providing power to a lower switch assembly.

For each switch assembly that has determined that it has a detonator, the last state machine involves sending a pair of pulses to the surface controller. These pulses will be relatively long (1 ms) pulses. The spacing between the pulses will inform the surface controller if the switch assembly is an inline switch assembly (pulses spaced 20 ms apart) or if the switch assembly is a bottom switch assembly (pulses spaced 10 ms apart) or if the switch assembly is a bottom switch assembly connected to a setting tool (pulses spaced 15 ms apart). The surface controller can count the number of received pulse pairs to then inform the user of how many switch assemblies were detected, and confirm that the lowest switch assembly is sending pulses with 10 ms spacing. In addition to these long pulses, each active switch assembly will send a short (24 microseconds) pulse shortly after it is powered up, to inform the switch assembly above it that there is a detonator-equipped switch assembly below. The surface controller may ignore these short pulses, as they are intended only for inter-switch assembly communication.

Figure 6:
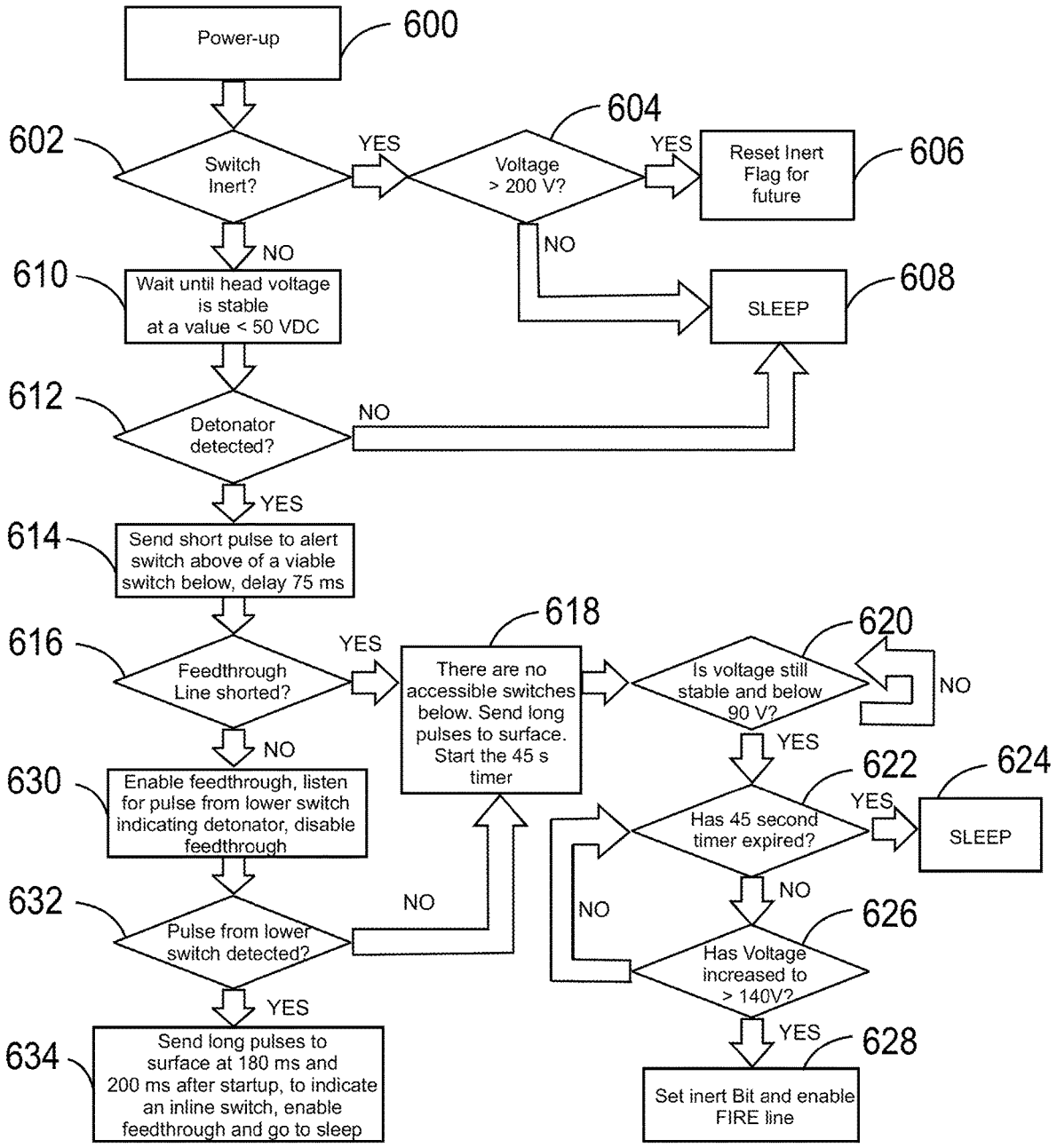
FIG. 6 is a flowchart of a method that describes the states through which a hybrid switch assembly goes while in the well.

A method for using a chain of switch assemblies programmed to go through the 6 states discussed above is now discussed with regard to FIG. 6. In this method, it is assumed that the plural switch assemblies have been assembled into a single chain and the chain has been lowered into a well and connected to the surface controller. With this assumption, in step 600, the chain is powered up, i.e., power is sent from the surface controller to the top most switch assembly of the chain (e.g., switch assembly 232A in FIG. 4) and the micro-controller of this switch assembly enters the first state. Note that the thru-line switch 234 and the detonator switch 236 in each switch assembly of the chain are open, and thus, no detonator is activated and no other switch assembly in the chain receives this voltage.

In step 602, the switch assembly determines if it has a flag indicating that the switch assembly is inert. If the result of this step is that a flag is present, the process advances to step 604 for determining whether an applied voltage is larger than a test threshold (200 V in this case). This step of checking for a threshold voltage and subsequent resetting of the flag is an optional step and serves mainly for maintenance and/or testing purposes. If the result of this determination is yes, the process advances to step 606, where the flag is reset. If the result of this determination is no, the micro-controller enters a sleep state in step 608.

If the result of the determination in step 602 is no, the process advances to step 610, where the micro-controller measures the head voltage (line voltage) and waits until it becomes stable. In step 612, the micro-controller enters the second state and determines whether a detonator is detected as being attached to the switch assembly. If the result of the determination is no, the micro-controller enters the sleep state in step 608. However, if the result of this determination is yes, the process advances to step 614, where the micro-controller sends a short pulse to the switch assembly above it to inform that it has a detonator. This is part of the inter-switch assembly communication scheme. No such feature is present in the traditional addressable switches.

Next, the micro-controller enters the third state, and determines in step 616 if the feedthrough line is shorted or not. If the result of this step is positive, the process advances to step 618, where the micro-controller determines that there are no accessible switch assemblies below. As a result of this determination, the micro-controller sends two long pulses to the surface controller to inform it about this determination. Thus, the micro-controller has entered the pre-fire state. In step 620, the micro-controller verifies that the line voltage is stable and below a certain threshold (e.g., 90 V). If the result is yes, the process advances to step 622 and starts a timer (e.g., 45 s timer) for preparing for receiving a firing voltage. If the times goes off without receiving a firing voltage, the micro-controller goes to sleep in step 624. However, if the time has not expired and it is determined in step 626 that the voltage has increased over a value of the firing voltage (e.g., 140V), the detonator switch is enabled in step 628 to fire the detonator and the micro-controller sets the inert flag. If the result of step 626 is that no firing voltage is detected, the process returns to step 622.

Returning to step 616, if a determination is made that the feedthrough line is not shorted, the process advances to step 630, the micro-processor enables the thru-switch 234 and enters the fourth state (LISTEN). In this state, the micro-processor listens for pulses from lower switch assemblies that have a detonator. If a pulse from a lower switch assembly is not detected in step 632, the process returns to step 618, meaning that the current switch assembly is the lowest in the chain that has a detector and the method proceeds to prepare this switch assembly for firing. If a pulse from a lower switch assembly is detected in step 632, the micro-controller enters the fifth state (INLINE) in step 634 and sends two pulses to the surface controller to indicate that the switch assembly is an inline switch assembly. Further, in this step, the micro-controller enables the thru-line switch 234 and then it goes to sleep.

The physical location of a switch assembly 232 has been assumed in FIG. 2 to be inside a sub that is associated with a gun assembly. However, it is possible to place the switch assembly at other locations along the gun string as now discussed. For example, according to an embodiment illustrated in FIG. 7, a system 700 includes a gun string 701 located in a wellbore 211. The controller 206 is located at the surface, next to the head of the wellbore 211. The thru-line 210 extends from the controller 206 to the gun string 701 through the wireline 222. The gun string 701 includes plural subs (only two subs 710 and 720 are shown) and plural gun assemblies (only one 730 is shown) connected to each other. The last gun assembly is connected to a setting tool 202. A setting tool detonator 250 may be located either in the setting tool 202 or in an adjacent sub, gun assembly or setting tool kit. When located in the well, the first sub 710 is upstream from the gun assembly 730 and the second sub 720 is downstream.

Figure 7:
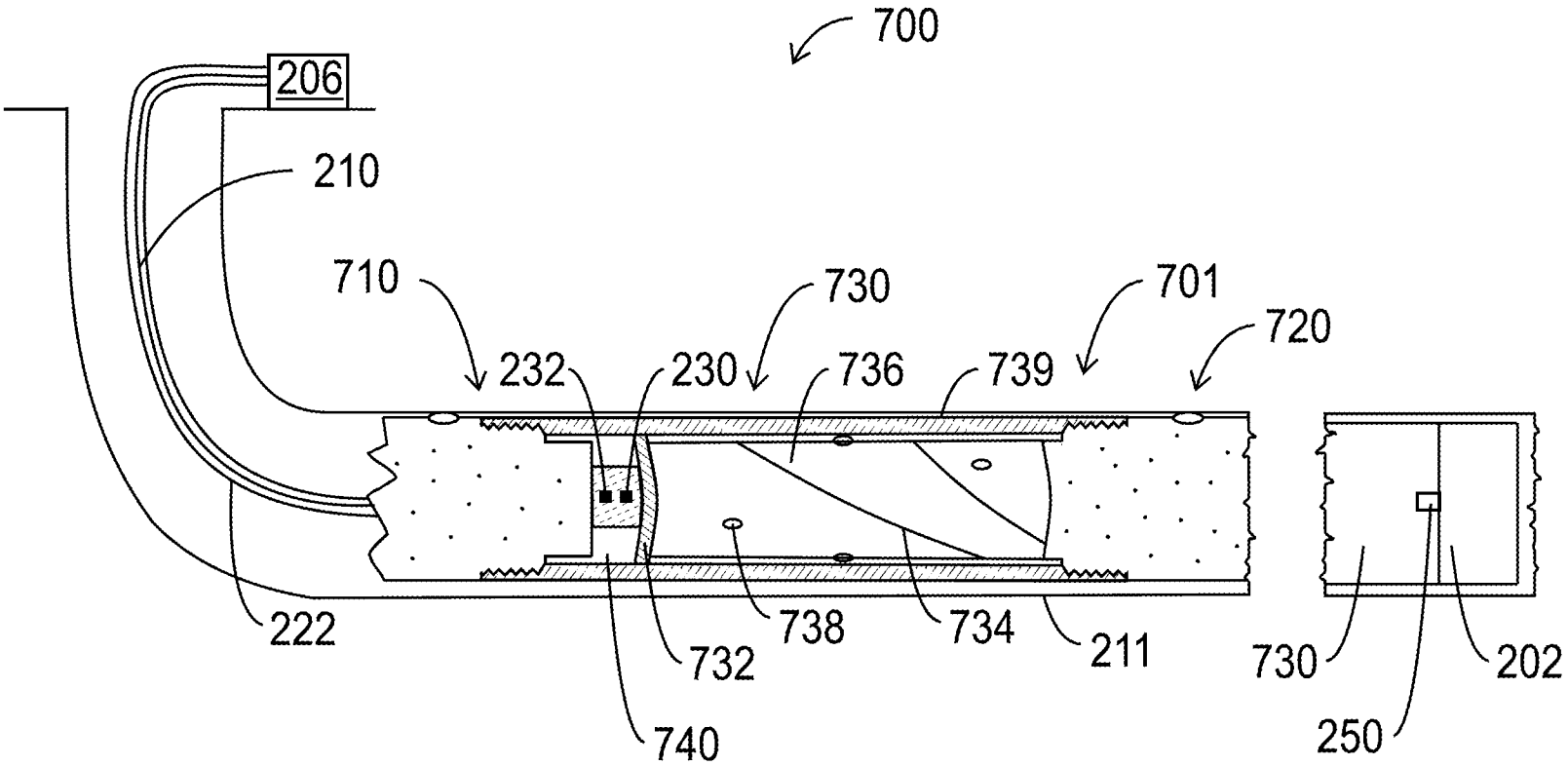
FIG. 7 illustrates a gun string and associated chain of switch assemblies.

While the traditional gun strings have each gun assembly directly sandwiched between two adjacent subs, according to this embodiment, there may be an additional element, a detonator block 740 located between the first sub 710 and the gun assembly 730 and also a contact end plate mechanism 732 that ensures electrical connection between the detonator block 740 and the gun assembly 730. This electrical connection does not involve wires. A switch assembly 232 and a detonator 230 are located inside the detonator block 740. Contact end plate mechanism 732 also connects to a detonation cord 734 that actuates the charges 738 in the gun assembly 730. FIG. 7 shows the detonation cord 734 being located outside a charge load tube 736. The charge load tube 736 is configured to hold the various charges 738. FIG. 7 also shows a carrier 739 connected to the sub 710 and housing the components of the gun assembly. Each gun assembly of the gun string may be connected to a corresponding detonator block 740, that holds a corresponding switch assembly 232 and detonator 230.

Thus, according to this embodiment, neither the detonator 230 nor the switch assembly 232 are located in the sub 710 or 720 as in the traditional gun strings. This is advantageous because the repeated activation of the detonator slowly damages the sub, which is expensive to replace. However, the cost of the detonator block 740 is lower than the cost of the sub as the detonator block may be made of cheaper materials (e.g., polymers) and thus it can be changed more often. Details of the detonator block 740 and contact end plate mechanism 732 are described in International Patent Application PCT/US2018/022846.

Figure 8:
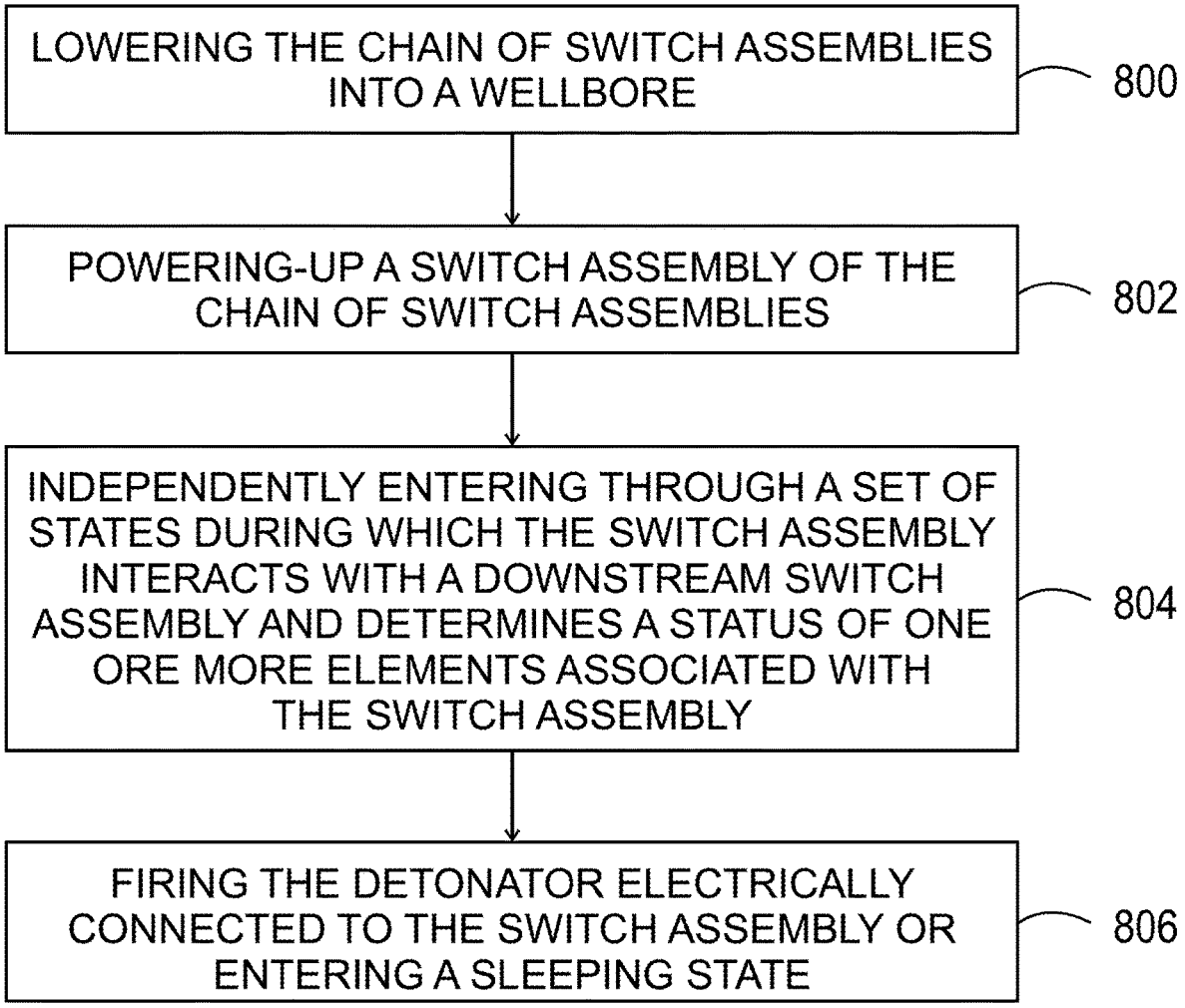
FIG. 8 is another flowchart of a method for actuating a detonator associated with a gun assembly.

A method for firing a detonator in a chain of switch assemblies is now discussed with regard to FIG. 8. The method includes a step 800 of lowering the chain of switch assemblies 232A to 232C into a wellbore 211, a step 802 of powering-up a switch assembly 232B of the chain of switch assemblies, a step 804 of independently entering through a set of states during which the switch assembly 232B interacts with a downstream switch assembly 232C and determines a status of one or more elements 230B associated with the switch assembly 232B, and a step 806 of firing a detonator 230B electrically connected to the switch assembly 232B or entering a sleeping state.

The disclosed embodiments provide methods and systems for actuating one or more gun assemblies in a gun string. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A method for firing a detonator in a chain of switch assemblies, the method comprising:

lowering the chain of switch assemblies into a wellbore;

powering-up a hybrid switch assembly of the chain of switch assemblies;

independently entering through a set of states during which the hybrid switch assembly interacts with a downstream switch assembly and determines a status of one or more elements associated with the downstream switch assembly; and based only on the status of the one or more elements associated with the downstream switch assembly, firing a detonator electrically connected to the hybrid switch assembly or entering a sleeping state.

2. The method of claim 1, wherein the hybrid switch assembly has no address.

3. The method of claim 1, wherein the hybrid switch assembly uses a pulsing scheme for communicating with an upstream switch assembly.

4. The method of claim 1, wherein the hybrid switch assembly enters through six different states during operation.

5. The method of claim 1, further comprising the step of determining, in the switch assembly, whether the detonator is connected to the hybrid switch assembly.

6. The method of claim 5, further comprising the step of sending a short pulse to an upstream switch assembly to inform the upstream switch assembly that the detonator is attached to the hybrid switch assembly.

7. The method of claim 6, further comprising the step of determining whether a thru-line that connects the hybrid switch assembly to the downstream switch assembly is shorted.

8. The method of claim 7, further comprising the step of determining, when the thru-line is shorted, that the hybrid switch assembly is the most bottom switch assembly in the wellbore.

9. The method of claim 8, further comprising the step of starting a timer.

10. The method of claim 9, further comprising the step of closing a detonator switch to fire the detonator when a line voltage becomes larger than a firing voltage within a time counted by the timer.

11. The method of claim 7, further comprising the step of closing a thru-line switch that communicates with a downstream switch assembly when the thru-line is not shorted.

12. The method of claim 11, further comprising:

determining whether a pulse from the downstream switch assembly is received;

sending two long pulses separated by a given time to a surface controller when the pulse from the downstream switch assembly is received; and entering the sleeping state.

13. The method of claim 1, further comprising the step of determining, in the hybrid switch assembly, whether a setting tool is connected to the switch assembly.

* * * * *